US011795639B2

(12) United States Patent
Briehl

(10) Patent No.: US 11,795,639 B2
(45) Date of Patent: Oct. 24, 2023

(54) MOBILE VEHICLE BARRIER

(71) Applicant: Breeze Invest GmbH, Vienna (AT)

(72) Inventor: Stephan Briehl, Torgelow (DE)

(73) Assignee: BREEZE INVEST GMBH, Vienna (AT)

( * ) Notice: Subject to any disclaimer, the term of this patent is extended or adjusted under 35 U.S.C. 154(b) by 415 days.

(21) Appl. No.: 16/647,093

(22) PCT Filed: Sep. 14, 2018

(86) PCT No.: PCT/EP2018/074930

§ 371 (c)(1),
(2) Date: Mar. 16, 2020

(87) PCT Pub. No.: WO2019/053209

PCT Pub. Date: Mar. 21, 2019

(65) Prior Publication Data

US 2020/0217026 A1 Jul. 9, 2020

(30) Foreign Application Priority Data

Sep. 15, 2017 (LU) ..... LU100444

(51) Int. Cl.
*E01F 13/12* (2006.01)
*E01F 13/02* (2006.01)

(52) U.S. Cl.
CPC ..... *E01F 13/12* (2013.01); *E01F 13/02* (2013.01)

(58) Field of Classification Search
CPC . E01F 13/12; E01F 13/02; E01F 13/08; E01F 13/123; E01F 15/086; E01F 15/088
See application file for complete search history.

(56) References Cited

U.S. PATENT DOCUMENTS 4,982,931 A 1/1991 Pomero
6,971,329 B1 * 12/2005 Stewart ..... E01F 13/028 116/63 P
D620,824 S * 8/2010 Hannah ..... D10/113.3
11,174,606 B1 * 11/2021 Lamore ..... E01F 13/026
2005/0201829 A1 * 9/2005 Dehart ..... E01F 13/12 404/6
2006/0078380 A1 * 4/2006 Dehart ..... F41H 11/08 404/6

FOREIGN PATENT DOCUMENTS

DE 202017003538 U1 * 11/2018
EP 0 343 091 A1 11/1989
(Continued)

OTHER PUBLICATIONS

International Search Report of PCT/EP2018/074930, dated Jan. 2, 2019.

*Primary Examiner* — Babajide A Demuren
(74) *Attorney, Agent, or Firm* — Collard & Roe, P.C.

(57) ABSTRACT

A mobile vehicle barrier includes a base portion and an upward-extending portion. The center of gravity of the mobile vehicle barrier is located in the upward-extending portion. Moreover, the upward-extending portion is spaced apart from a longitudinal edge of the base portion. This way, when a vehicle drives onto the vehicle barrier, the vehicle barrier may be tipped over in the direction of movement of the vehicle, and the vehicle jacks itself up on the tipped-over vehicle barrier.

11 Claims, 4 Drawing Sheets

(56) References Cited

FOREIGN PATENT DOCUMENTS

| | | | | | |
|---|---|---|---|---|---|
| GB | 2294488 | A | * | 5/1996 | ..... E01F 13/02 |
| JP | 2003-013416 | A | | 1/2003 | |
| JP | 2014-080744 | A | | 5/2014 | |
| WO | WO-2018145688 | A1 | * | 8/2018 | |
| WO | WO-2020037379 | A1 | * | 2/2020 | ..... E01F 15/003 |
| WO | WO-2020144612 | A1 | * | 7/2020 | ..... E01F 13/02 |

* cited by examiner

MOBILE VEHICLE BARRIER

CROSS REFERENCE TO RELATED APPLICATIONS

This application is the National Stage of PCT/EP2018/074930 filed on Sep. 14, 2018, which claims priority under 35 U.S.C. § 119 of Luxembourg Application No. LU100444 filed on Sep. 15, 2017, the disclosure of which is incorporated by reference. The international application under PCT article 21(2) was not published in English.

The present invention relates to a mobile vehicle barrier. More specifically, the present invention relates to a mobile vehicle barrier which tips over when a vehicle drives over it, becomes wedged between the vehicle and the ground and thus halts movement of the vehicle.

Mobile vehicle barriers are used for protecting mostly temporary events/occasions and are set up when needed.

Barriers according to the prior art and according to tests are based on the principle that the kinetic energy and the momentum of the vehicle impinging on the barrier is transmitted to the barrier and thus causes the velocity of the vehicle to be reduced. As was shown by recent tests, however, such barriers, which are usually made of concrete, only offer limited protection as they may be shoved aside by heavy vehicles or—which is particularly disadvantageous—may even be hurled away by the vehicle and then pose an additional risk. Moreover, the effectiveness of such a barrier also strongly depends on the angle at which the vehicle impinges on the vehicle barrier and especially on the mass of the barrier. For the vehicle barrier to be effective, the mass of such a vehicle barrier, which is based on momentum transmission, must be considerably greater than the one of the impinging vehicle. In addition, in the event of panic, such vehicle barriers pose considerable obstacles to escaping persons.

Therefore, the object of the present invention is to provide a vehicle barrier which reliably halts heavy vehicles such as trucks or transporters. Preferably, the halting effect and complete standstill of the vehicle are to be accomplished over the shortest possible distance. Furthermore, it is preferable if as little as possible debris is created and hurled away by the halting of the vehicle.

This object is achieved by the features of claim 1. The sub-claims relate to embodiments of the present invention.

In the scope of the present invention, the direction indications used relate to a vehicle barrier standing on even ground or on the roadway. In this regard, a transverse direction of the vehicle barrier is a direction running in the direction of movement of a vehicle driving onto the vehicle barrier. For the descriptions provided herein, a vehicle is assumed whose direction of movement is parallel to the transverse direction (width) of the vehicle barrier. However, the vehicle barrier is also effective if a vehicle does not drive onto the vehicle barrier in a direction parallel to the transverse direction. In addition, a longitudinal direction of the vehicle barrier is the longest dimension of the vehicle barrier parallel to the roadway surface; consequently, the transverse direction is perpendicular to the longitudinal direction. The ground or roadway may be constituted as desired. The term "height" is to be understood as extending upwards from the roadway. A longitudinal edge of the vehicle barrier is parallel to the longitudinal direction.

A mobile vehicle barrier according to one aspect of the present invention comprises a base portion and an upward-extending portion. The center of gravity of the mobile vehicle barrier is located in the upward-extending portion.

Moreover, the upward-extending portion is spaced apart from a longitudinal edge of the base portion. This way, when a vehicle drives onto the vehicle barrier, the vehicle barrier may be tipped over in the direction of movement of said vehicle, and the vehicle jacks itself up on the tipped-over vehicle barrier. In this process, the tipped-over vehicle barrier is clamped between the vehicle and the roadway. By this clamping and the jacking-up of the vehicle, the halting effect of the vehicle barrier is created. An additional braking effect is achieved by the base portion of the barrier becoming wedged between the vehicle on the upper side of the base portion and with the roadway on the bottom side of the base portion and the upward-extending portion of the barrier gaining contact with the ground. This way, additional friction is caused, which contributes to braking the vehicle by means of the vehicle barrier.

In other words, the upward-extending portion acts as a lever over which the base portion and thus the entire vehicle barrier is tipped over in the direction of movement by the colliding vehicle. This way, the vehicle is jacked up by the part of the base portion over which it already drove when reaching the upward-extending portion.

The position of the center of gravity in the upward-extending portion is preferably selected in such a way that the vehicle barrier cannot be tipped over manually by persons but tips over when a vehicle drives onto it.

As the vehicle is jacked up, less debris is created since the full impact of force by the vehicle barrier is developed under the vehicle and the spreading of debris is thus already shielded by the vehicle itself. In addition, in vehicles, the area where the vehicle barrier takes effect is usually constructed in a very stable manner, which further reduces the probability of debris being created.

A mobile vehicle barrier according to the above aspect may further comprise a dimension of the base portion in the transverse direction which is less than or approximately equal to a height of the upward-extending portion. This way, the vehicle barrier may tip over more easily and may be adapted for various purposes, for example only for passenger cars in areas that are not accessible for larger vehicles anyway, or for vehicle barriers that are capable of barring all vehicle sizes.

A mobile vehicle barrier according to one of the above aspects may comprise posts in the upward-extending portion. This way, the vehicle barrier allows pedestrians to pass through, who may walk through between the posts. Mounted police may pass through the barrier as well. When the vehicle barrier tips over, it then rests on the roadway with a head area of the posts. If posts are present or if the upward-extending portion is not continuous in general, the center of gravity of the vehicle barrier does not have to be physically located in a part of the upward-extending portion but may also be situated in a spacing between the posts or outside the physical part of the upward-extending portion.

A mobile vehicle barrier according to one of the above aspects may have a distance of at least 80 cm between the posts. This is advantageous as the German requirements for escape routes are met this way.

A mobile vehicle barrier according to one of the above aspects may have a dimension of the base portion of less than 2.5 m in the longitudinal direction. This is advantageous as the vehicle barriers may thus be loaded onto a truck transversely to the direction of movement.

A mobile vehicle barrier according to one of the above aspects may comprise a reception for industrial trucks. This is advantageous as the vehicle barrier may thus be simply loaded and/or transported by means of a forklift, a telescopic handler or a lifting carriage.

A mobile vehicle barrier according to one of the above aspects may comprise at least one attachment point. This is advantageous as the vehicle barrier may thus be simply loaded and/or transported by means of the loading crane of a truck, for example. An attachment point may, for example, be a thread, into which an eye bolt may be screwed, or eyelets, hooks, lifting points, etc. that are directly molded to the vehicle barrier.

A mobile vehicle barrier according to one of the above aspects may comprise a base portion that is formed sloping towards a circumferential edge of the base portion. Consequently, a base portion results which is elevated in a middle area, compared to a circumferential edge area or the circumferential edge. In said middle area, preferably the upward-extending portion is arranged. The arch or flattening from the middle area towards the circumferential edge is preferable as the risk of tripping over it is thus reduced for pedestrians passing through the vehicle barrier. Moreover, driving onto the base portion is facilitated, which concerns the vehicle to be halted on the one hand, and baby strollers or bicycles passing through the vehicle barrier on the other hand.

A mobile vehicle barrier according to one of the above aspects may comprise a sharp edge at the upper end of the upward-extending portion. This advantageously improves the halting effect of the vehicle barrier as the vehicle barrier may easier become wedged with the roadway, and the wedging effect is enhanced. A sharp edge in the sense of this invention is configured in such a way that it cannot cause injury to persons or animals (e.g. police horses) but that the edge itself is as distinct as possible.

Likewise, it is also conceivable that the vehicle barrier comprises at least one tip in the upward-extending portion which, after the vehicle barrier is tipped over by the vehicle driving onto it, pierces itself into the roadway or is pushed into the roadway by the motion in the direction of movement. Since such a tip is a source of injury for pedestrians or animals, it is conceivable to provide it with a protective cover, if necessary, which uncovers the tip when the vehicle barrier tips over. This may be a suitable foam material or breaking plastic.

A mobile vehicle barrier according to one of the above aspects may have a total weight of equal to or less than 1000 kg. This is advantageous as, on the one hand, such a vehicle barrier may thus be easily loaded and transported and, on the other hand, it has sufficient mass for reliably halting a vehicle driving onto it.

A mobile vehicle barrier according to one of the above aspects may comprise the following dimensional ranges, wherein all intermediate dimensions are expressly indicated and the dimensions may be selected independently of each other: a dimension in the transverse direction of the base portion of at least 65 cm or less than or equal to 100 cm, a dimension in the longitudinal direction of a maximum of 250 cm, and a height of the upward-extending portion of at least 93 cm or a maximum of 125 cm.

A mobile vehicle barrier according to one of the above aspects may be manufactured from metal and/or concrete. This is advantageous for a stable and cost-efficient design of the vehicle barrier. The metal may be a ductile metal.

A mobile vehicle barrier according to one of the above aspects may comprise a hollow base portion. This may be advantageous for the selection of the center of gravity of the vehicle barrier. Furthermore, the vehicle barrier with a hollow base portion only stands on the ground or the roadway with its circumferential edge. This facilitates wedging of the vehicle barrier when a vehicle drives onto it. This may also be combined with the above-mentioned arch or flattening from the middle area towards the circumferential edge.

In a mobile vehicle barrier according to one of the above aspects, indentations may be formed in a head area of the posts. This is advantageous as due to the bridge resulting between the indentation and the outer sides of the posts, an edge results which facilitates wedging between the vehicle driving onto the vehicle barrier and the roadway and thus increases the halting effect.

The above features may be combined with each other as desired.

Further characteristics and advantages of the invention will become apparent in course of the following description of the embodiments, which is only exemplary and not limiting, with reference to the accompanying drawings. The Figures show the following:

Figure 1:
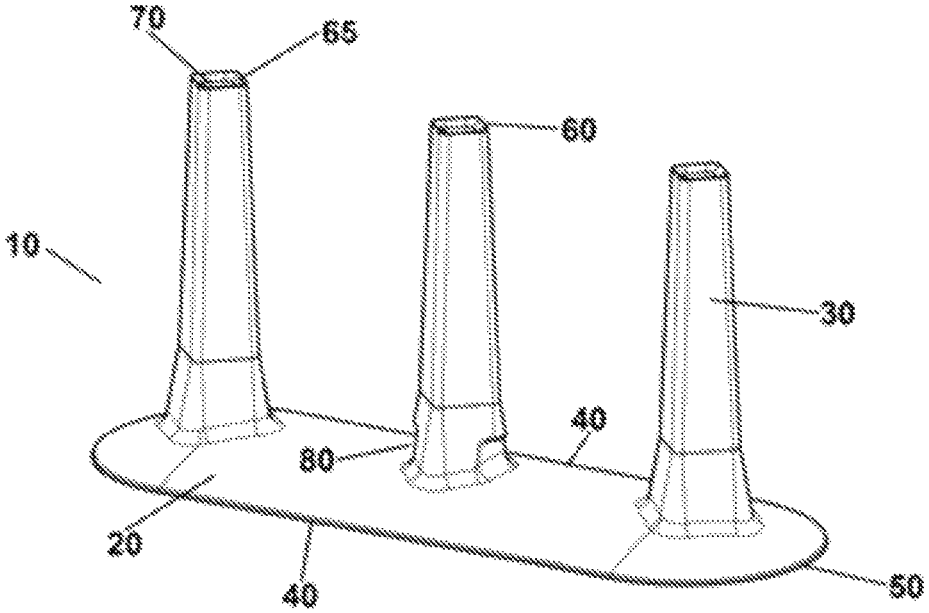
FIG. 1 is a perspective view of an embodiment of the mobile vehicle barrier.

With initial reference to FIG. 1, an embodiment of a mobile vehicle barrier 10 is shown, which comprises a base portion 20 and three posts 30. The posts 30 are arranged in a middle area of the base portion 20. The base portion 20 comprises two longitudinal edges 40, which are parallel to each other and parallel to a longitudinal direction of the vehicle barrier 10. One circumferential edge 50 comprises the longitudinal edges 40.

Figure 2:
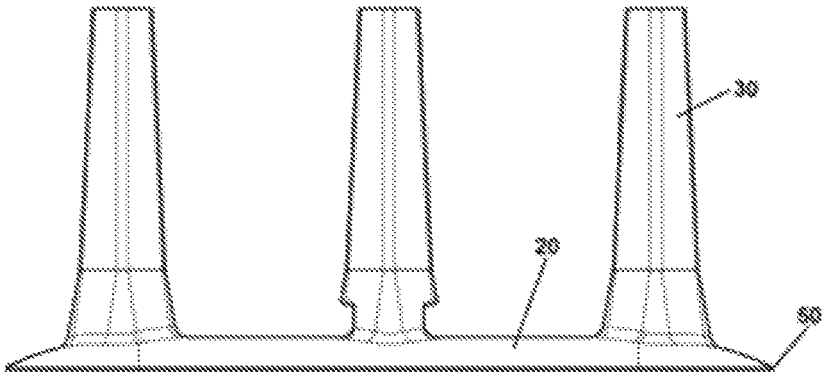
FIG. 2 is a front view of the vehicle barrier shown in FIG. 1.

The middle area of the base portion 20, in which the three posts 30 are arranged, is constructed in an elevated manner compared to the circumferential edge 50. This results in an arch of the base portion 20 from the circumferential edge 50 to the posts 30. In the present case, the base portion 20 is hollow, which means that it only lies or stands on the ground or the roadway with its circumferential edge 50. On the one hand, this makes it easier for pedestrians to pass through without the risk of tripping, and, on the other hand, it facilitates tipping over of the entire vehicle barrier 10. The arch of the base portion 20 can be seen very well in FIG. 2.

Figure 3:
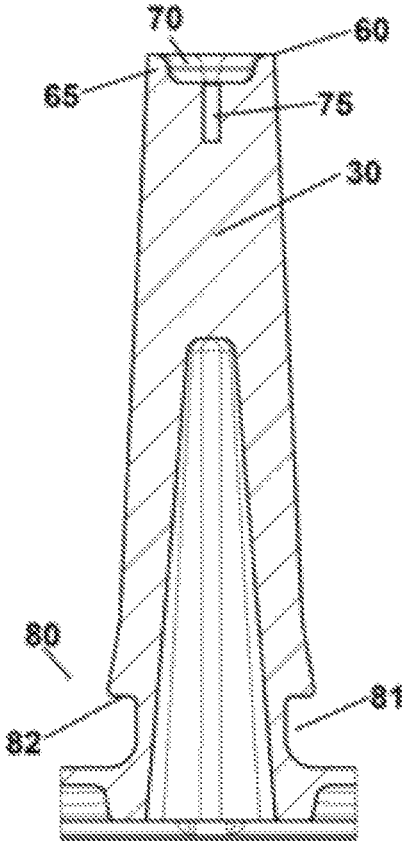
FIG. 3 is a sectional view of the middle post of the vehicle barrier shown in FIGS. 1 and 2.

Moreover, in the embodiment shown, the posts 30 are hollow in a lower area and solid in the head area (see FIG. 3). By means of the ratio between the hollow and the solid parts of the posts 30 and the configuration of the base portion, the center of gravity of the vehicle barrier 10 may be selected or adjusted accordingly and thus the tipping behavior (the force required, etc.) may be influenced or selected in this embodiment.

The posts 30 extend upwards from the base portion 20. The posts 30 are essentially cuboid and have a circumferential head edge 60 and an indentation 70 in their head area, wherein a thread 75 (see FIG. 3) is arranged in the indentation 70. An attachment point (e.g. an eye bolt) may be screwed into the thread 75, for example in order to be able to lift the vehicle barrier 10.

The indentation 70 results in the head area of the posts 30 having a portion with reduced wall thickness 65. This way, the head area and particularly the head edge 60 may better pierce itself into the roadway or the ground in the tipped-over state (see FIG. 4).

In addition, in this embodiment, the side surfaces of the cuboid posts 30 are rotated by 45° to the longitudinal edge 40 (see FIGS. 1 and 2), so that during tipping over, only the corners of the head edge 60 rest on the ground and may thus become wedged with the ground or pierce themselves into it more easily.

In the embodiment shown, the middle post 30 comprises a reception 80 for industrial trucks. The reception 80 is formed by recesses 81 in the foot area of the middle post 30 (see, for example, FIG. 3). When the prongs of an industrial truck are introduced into the reception 80 and the vehicle barrier 10 is then lifted, the vehicle barrier 10 rests on the shoulders 82 (see FIG. 3).

Figure 4:
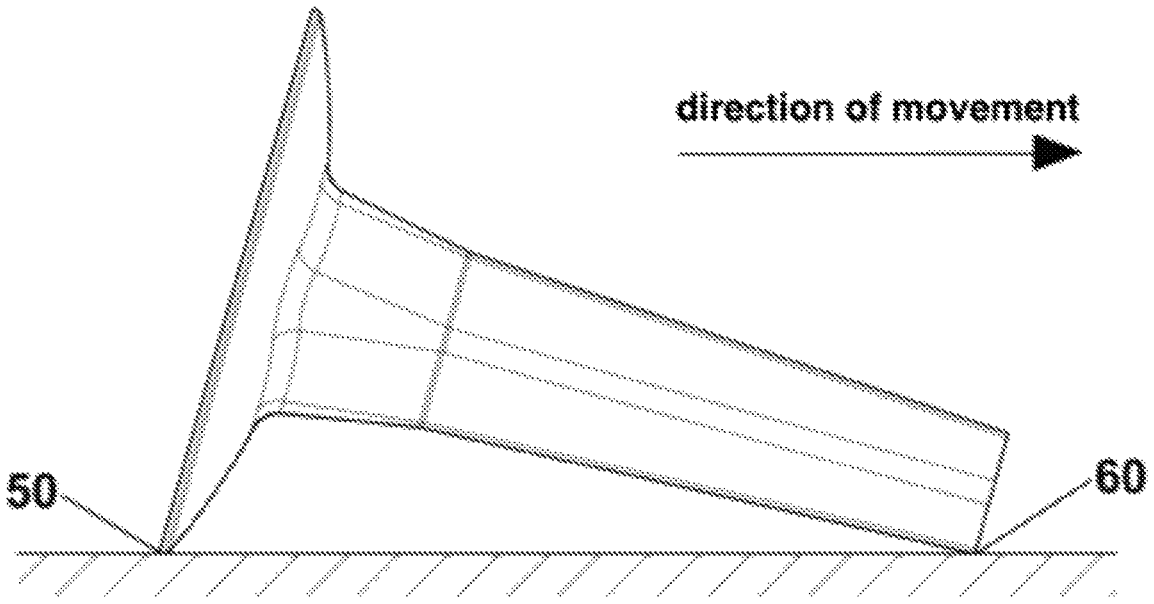
FIG. 4 is a side view in the tipped-over state of the vehicle barrier shown in FIG. 1.

FIG. 4 shows the vehicle barrier 10 in the tipped-over state after a vehicle (not shown) has driven onto it. In the case shown, the vehicle would have driven onto the vehicle barrier 10 from the left to the right (see arrow in FIG. 4). The part of the base portion 20 extending upwards from the ground is wedged with the vehicle, and the lower part of the base portion 20 is wedged with the ground. As can be seen, the head area of the posts 30 (only one visible) also rests on the ground with its head edge 60 and thus wedges or pierces itself into the ground when the tipped-over vehicle barrier 10 is pushed to the right in FIG. 4. This corresponds to the direction of movement of the vehicle that has tipped over the vehicle barrier 10 and has become wedged with it. The vehicle wedged with the vehicle barrier 10 is thus braked by the friction between the circumferential edge 50 and the head edge 60 and the ground.

LIST OF REFERENCE NUMBERS

10 mobile vehicle barrier
20 base portion
30 post
40 longitudinal edge
50 circumferential edge
60 head edge
65 portion with reduced wall thickness
70 indentation
75 thread
80 reception
81 recess
82 shoulder

The invention claimed is:

1. A mobile vehicle barrier comprising a base portion and an upward-extending portion extending from the base portion, wherein the center of gravity of the mobile vehicle barrier is in the upward-extending portion and the upward-extending portion is spaced apart from a longitudinal edge of the base portion and wherein the upwardly-extending portion comprises posts, wherein the mobile vehicle barrier can be passed by pedestrians between individual posts and wherein the mobile vehicle barrier is designed and adapted to tip over when impacted.

2. The mobile vehicle barrier according to claim 1, wherein the base portion has a dimension in the transverse direction which is less than a height of the upward-extending portion.

3. The mobile vehicle barrier according to claim 1, further comprising a reception for industrial trucks.

4. The mobile vehicle barrier according to claim 1, further comprising at least one attachment point.

5. The mobile vehicle barrier according to claim 1, wherein the base portion is elevated in a middle area and formed sloping towards a circumferential edge of the base portion.

6. The mobile vehicle barrier according to claim 1, wherein the upward-extending portion comprises at least one circumferential head edge at its upper end, wherein the head edge is constructed with a sharp edge.

7. The mobile vehicle barrier according to claim 1, comprising at least one of the following:

a total weight of equal to or less than 1000 kg;
the distance between the posts is at least 80 cm;
the base portion has a dimension of less than 2.5 m in the longitudinal direction.

8. The mobile vehicle barrier according to claim 1, which is manufactured of metal and/or concrete.

9. The mobile vehicle barrier according to claim 8, which is manufactured of a ductile metal.

10. The mobile vehicle barrier according to claim 1, wherein indentations are formed in a head area of the posts.

11. The mobile vehicle barrier according to claim 1, wherein the base portion is hollow.

* * * * *